United States Patent [19]

Goldfarb et al.

[11] Patent Number: 5,025,963

[45] Date of Patent: Jun. 25, 1991

[54] ANTI-THEFT HANGER FOR GARMENTS, FOR USE IN STORES OR CLOCKROOMS

[75] Inventors: Charles Goldfarb, Paris; Yvon David, Dunkerque, both of France

[73] Assignee: Societe Engiplast, Roubaix, France

[21] Appl. No.: 288,983

[22] Filed: Dec. 22, 1988

[51] Int. Cl.[5] ..... E05B 69/00

[52] U.S. Cl. ..... 223/85; 211/4

[58] Field of Search ..... 223/85, 91, 93, 95, 223/96, 92; 211/4, 8, 7; 70/59, 60

[56] References Cited

U.S. PATENT DOCUMENTS

| | | | |
|---|---|---|---|
| 4,069,691 | 1/1978 | Simpson | 211/4 X |
| 4,073,415 | 2/1978 | Pegg | 223/92 |
| 4,221,298 | 9/1980 | Wright et al. | 223/85 X |
| 4,265,380 | 5/1981 | Webster et al. | 223/85 |
| 4,685,572 | 8/1987 | Jamison | 223/85 X |

FOREIGN PATENT DOCUMENTS

| | | | |
|---|---|---|---|
| 2755470 | 6/1979 | Fed. Rep. of Germany | 70/59 |
| 3542108 | 6/1986 | Fed. Rep. of Germany . | |
| 1167190 | 7/1958 | France . | |

*Primary Examiner*—Werner H. Schroeder

*Assistant Examiner*—David K. Suto

*Attorney, Agent, or Firm*—McAulay Fisher Nissen & Goldberg

[57] ABSTRACT

This invention relates to an anti-theft hanger for garments, adapted to be used in stores or cloakrooms, comprising a support whose shape matches that of the garment to be hung up on the hanger, a hook located in the central part of the hanger passing around a suspension bar and at least one flexible anti-theft member such as chain or cable, connected to this support, and adapted to be passed through a tubular part of the garment, such as jacket sleeve, trouser leg or skirt, this flexible member terminating, at its free lower end, in a ring allowing passage of a padlock and extending across the opening of the hook of the hanger by passing through an upper hole made in the curved part of the hook; in order to simplify manufacture and use and to improve its aesthetic character, the flexible member of the anti-theft hanger also passes through a lower hole which is made in the central part of the support of the hanger and the flexible member is fast, at its end opposite the one fixed to the ring with a stop member opposing passage through the upper hole when the flexible member is pulled downwardly.

19 Claims, 4 Drawing Sheets

ANTI-THEFT HANGER FOR GARMENTS, FOR USE IN STORES OR CLOCKROOMS

FIELD OF THE INVENTION

The present invention relates to an anti-theft hanger for garments, for use in stores or cloakrooms.

BACKGROUND OF THE INVENTION

Anti-theft hangers are already known which are provided with a flexible anti-theft member, such as chain or cable, connected to the support of the hanger whose shape matches that of the garment having to be hung up and which is extended upwardly, in its central part, by a hook adapted to pass around a suspension bar. This flexible anti-theft member is adapted to be threaded through a tubular part of the garment borne by the hanger, such as a jacket sleeve, the two ends of the flexible member being fast with hooking elements making it possible to close the flexible member around the garment, for example by means of a padlock or lock, in order to prevent theft of said garment. Such anti-theft hangers are described for example in Patents FR-A-1 167 190 and DE-A-3 542 108. Patent FR-A-1 167 190 describes a hanger of which the support is pierced, in its central part, with a hole traversed by a suspension bar and which is therefore permanently fixed on this bar. This hanger bears at the two ends of its two lateral arms, two chains hanging freely, which may be connected to each other at their lower ends by means of a ring and padlock. Such an anti-theft hanger presents the drawback of not being detachable from the suspension bar and of using, as flexible member, two separate chains passed respectively through the two sleeves of a hung up jacket. Consequently, it is not convenient to manipulate since the two chains must be withdrawn from the two sleeves in order to be able to separate the jacket from the hanger. In addition, it is cumbersome, heavy, unaesthetic and is not suitable for protecting a skirt or trousers from theft. Furthermore, the anti-theft hanger according to Patent DE-A-3 542 108 comprises a flexible anti-theft cable vertically traversing the central part of the support of the hanger and sliding inside the upper hook. The two ends of the cable may be hooked to each other by means of a lock with key. In that case, the flexible anti-theft cable, when it is hooked to itself to form a closed loop, prevents a garment hung from the hanger from being detached therefrom and also prevents the hanger itself from being unhooked from the suspension bar. However, such an anti-theft hanger presents the drawback that it requires one lock per hanger and it is therefore particularly expensive. Furthermore, that part of the flexible cable which emerges from the end of the upper hook hangs freely outside the hanger and may be placed anyhow, this considerably hindering manipulation of the hangers, particularly when the garment is hung on the hanger and it is desired to position the anti-theft device by hooking the two ends of the cable to each other. In addition, the anti-theft hanger suspended with its flexible cable closed around a jacket sleeve for example is not aesthetic since the flexible cable must pass partially outside the garment and is permanently visible. This is particularly inconvenient when a succession of garments are hung side by side from the same suspension bar as, in that case, all the flexible anti-theft cables appear side by side. Finally, such an anti-theft hanger protects only a jacket or coat from theft and cannot be used with skirts or trousers.

It is an object of the present invention to overcome these various drawbacks by providing an anti-theft hanger of particularly simple design, inexpensive to manufacture, easy to use and not being detrimental to the aesthetic nature of the garments hung up.

SUMMARY OF THE INVENTION

To that end, this anti-theft hanger for garments, adapted to be used in stores or cloakrooms, comprising a support whose shape matches that of the garment to be hung up on the hanger, a hook located in the central part of the hanger passing around a suspension bar and at least one flexible anti-theft member such as chain or cable, connected to this support, and adapted to be passed through a tubular part of the garment, such as jacket sleeve, trouser leg or skirt, this flexible member terminating, at its free lower end, in a ring allowing passage of a padlock and extending across the opening of the hook of the hanger by passing through an upper hole made in the curved part of the hook, is characterized in that the flexible member also passes through a lower hole which is made in the central part of the support of the hanger and the flexible member is fast, at its end opposite the one fixed to the ring, with a stop member opposing passage through the upper hole when the flexible member is pulled downwardly.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
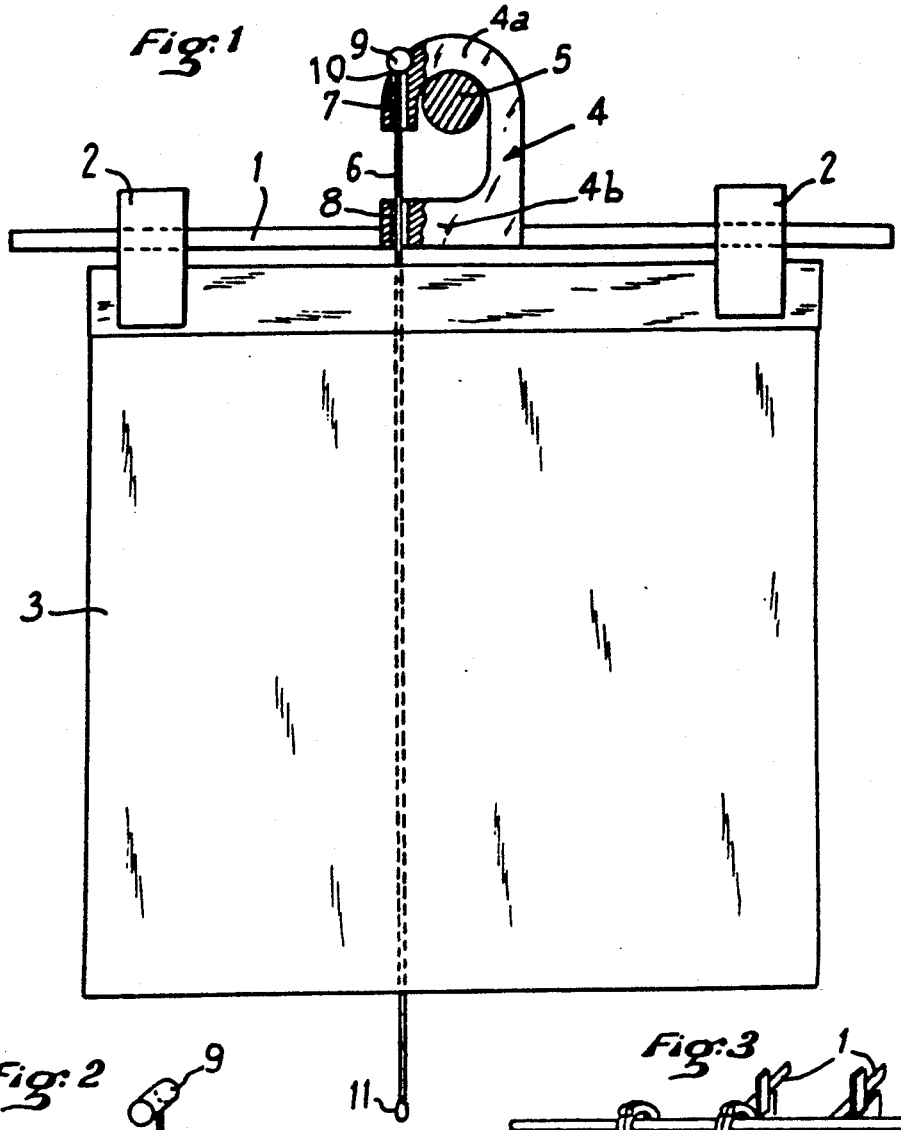
FIG. 1 is a view in elevation of an anti-theft hanger according to the invention.
Figure 2:
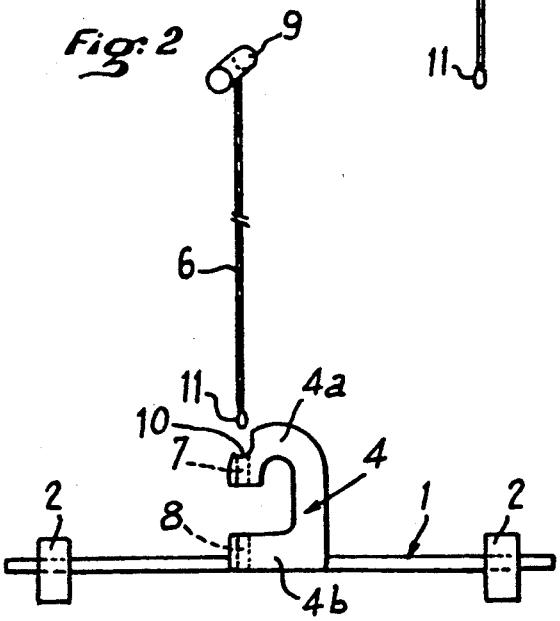
FIG. 2 is a view in elevation of the anti-theft hanger of FIG. 1, the flexible member being shown separate from the hanger proper.
Figure 3:
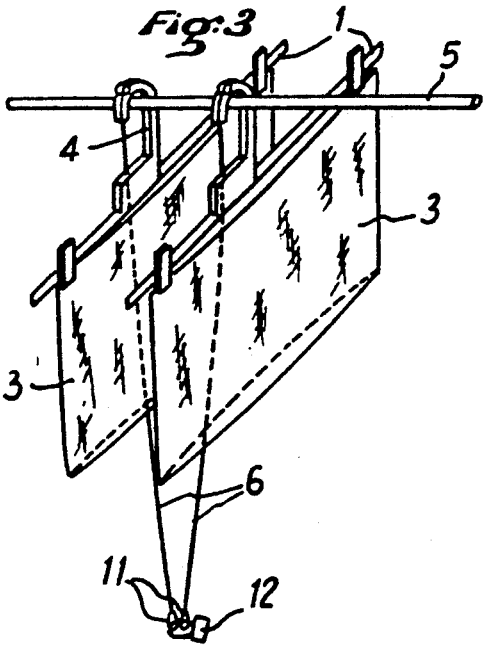
FIG. 3 is a view in perspective of several anti-theft hangers attached together.

Referring now to the drawings, the anti-theft hanger according to the invention, shown in FIGS. 1 to 3, is constituted by a horizontal bar 1 provided with grippers 2 and forming the support for a skirt 3 hanging vertically. The bar 1 is fast with a central part 4 forming a hook extending upwardly. This hook 4 is adapted to pass around a suspension bar 5 to which the hanger is hooked.

Furthermore, the anti-theft hanger comprises a robust flexible member 6 constituted, for example, by a cable, a chain or a semi-rigid rod, which is engaged to slide vertically in the hook 4. More particularly, the flexible member 6 extends vertically across the opening of the hook 4 of the hanger and it passes successively through an upper vertical hole 7 made in the end part of the upper curve of the hook 4 passing around the bar 5, and through a lower vertical hole 8 made right through the base 4b of the hook 4 located in the central part of the hanger and by which it is connected to the bar 1. The lower hole 8 in the base 4b is preferably aligned vertically with the upper hole 7, but it might also be offset horizontally. The flexible member 6 is fast, at its upper end, with a stop member 9 opposing passage through the upper hole 7 when the flexible member 6 is pulled downwardly and which is housed in a notch 10, of corresponding shape, which is made in the outer edge of the curved part 4a of the hook 4, at the spot where the upper hole 7 opens. At its lower end, the flexible member 6 is fast with a ring 11 whose dimensions are chosen to be sufficiently small to enable it to pass through the lower hole 8. This hole 8 may have a width limited in the horizontal direction or it may be constituted by an elongated slot in base 4b to allow a certain degree of freedom for the flexible member in the elongated slot. It is thus possible to hook the hanger to the suspension bar 5 and to pass the ring 11 and the cable 6 through the lower hole 8, in order to pass around the bar 5 completely, thus preventing the hanger from being removed from the bar 5.

In order to protect skirt 3 from theft, it suffices to connect the lower end ring 11 of the hanging flexible member 6, extending vertically inside the skirt 3 and therebeneath, to one or more similar rings 11 of flexible members 6 associated with adjacent skirts 3. As may be seen more clearly in FIG. 3, such connection may be effected very simply and economically by means of a padlock 12 passing through the various rings 11.

Figure 4:
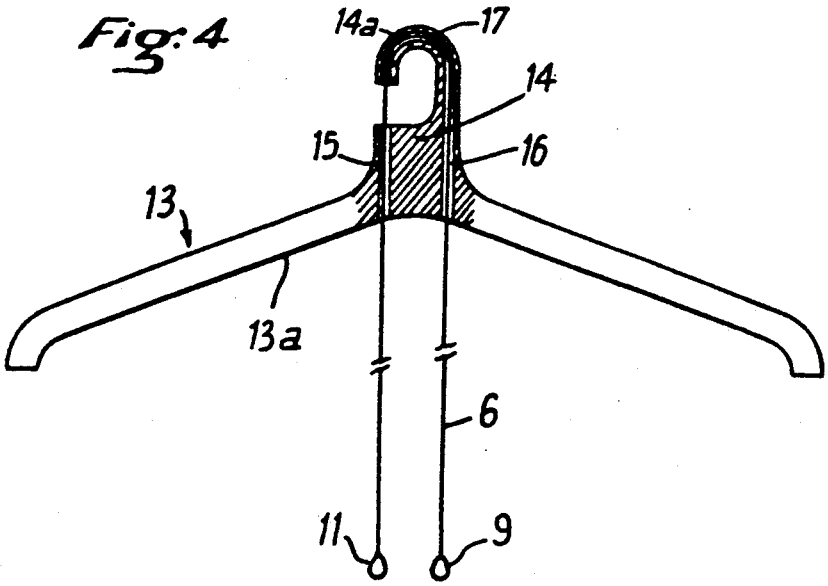
FIG. 4 is a view in elevation, with parts torn away, of a variant embodiment of the anti-theft hanger.
Figure 5:
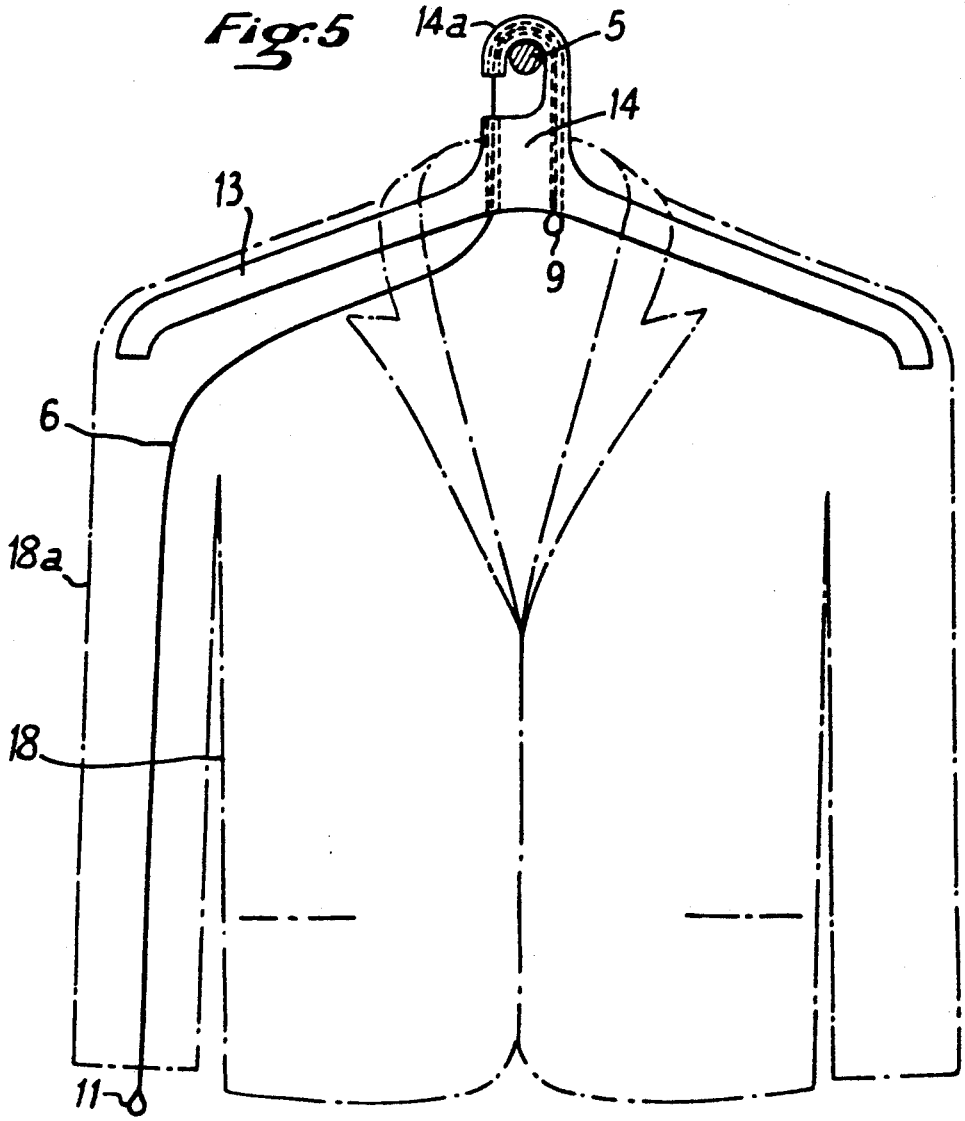
FIG. 5 is a view in elevation of a hanger according to FIG. 4 carrying a jacket.

In the variant embodiment illustrated in FIG. 4, the anti-theft hanger comprises a support 13 made of solid, rigid material, for example wood, metal or plastics material. This support 13, of conventional shape, i.e. in the form of a downwardly open obtuse angle, is pierced, in its upper central part 14 forming a suspension hook, with vertical holes 15 and 16 which allow passage of the flexible member 6 therethrough and across the opening of the suspension hook, as in the case of the hanger shown in FIG. 1. More particularly, the vertical hole 16 which opens out in the lower face 13a of the hanger 13, is extended, at its upper end, by a curved hole 17 which opens out in the lower end face of the upper curved part 14a of the hook 14, above and in the axis of the vertical hole 15 which opens out in its lower part in the lower face 13a of the support 13. The flexible member 6 thus follows a path in the form of an upturned U through the central part of the hanger, the part bearing the stop member 9 at its end extending through holes 16 and 17, whilst the part passing through the lower hole 15 bears the ring 11 at its lower end. There again, the ring 11 is provided to be sufficiently small to be able to pass freely through the lower hole 15. This arrangement makes it possible to hang a jacket 18 (FIG. 5) on the hanger 13 and to protect this jacket from theft. To that end, the vertical part of the flexible member 6 terminating in the ring 11 is pulled to a maximum until the stop member 9 is applied against the lower face 13a of the hanger 13. At that moment, the part of the flexible member 6 to which the ring 11 is attached, has its maximum length and it may be passed through a sleeve 18a of the jacket, as shown in FIG. 5. It then suffices to attach the ring 11 to adjacent rings, by means of padlocks 12, as in the case illustrated in FIG. 3, to prevent any theft of jacket 18 from the hanger 13 and of the hanger itself from the bar 5.

Figure 6:
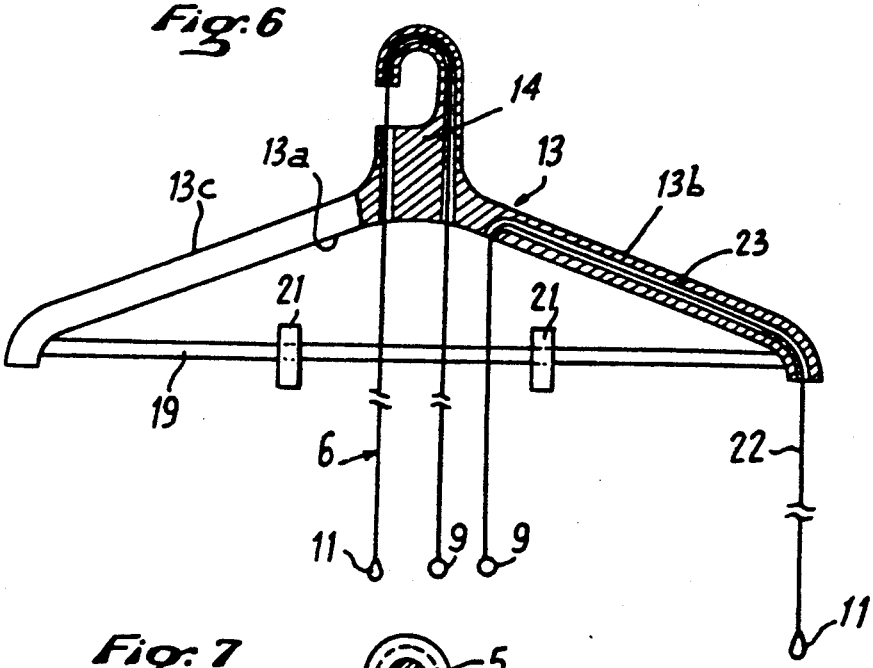
FIG. 6 is a view in elevation, with parts torn away, of another variant embodiment of the anti-theft hanger according to the invention.
Figure 7:
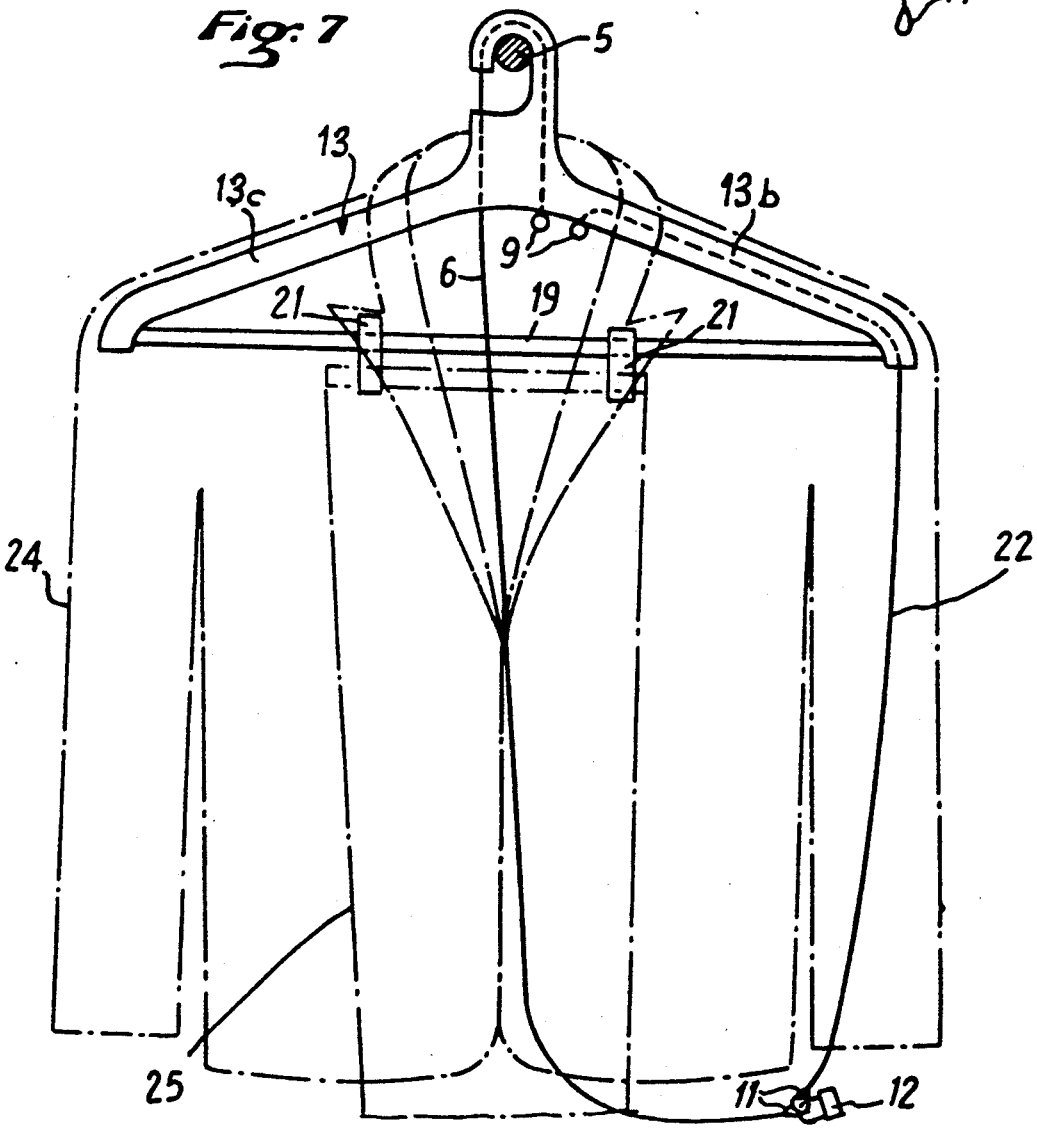
FIG. 7 is a view in elevation of a hanger according to FIG. 6 carrying a jacket and trousers.

In the variant embodiment of the invention shown in FIGS. 6 and 7, the anti-theft hanger comprises, in addition to support 13, a horizontal bar 19 extending between the lower ends of its two inclined arms 13b, 13c and which bears grippers 21 for suspending a skirt or trousers from this bar 19. In that case, the hanger 13 is provided, in addition to the flexible member 6 extending vertically, in the form of an upturned U, through the upper central hook 14 of the hanger, with another flexible member 22 which extends through a hole 23 made through an inclined arm 13b of the hanger 13. This hole 23 opens out in the lower face of the end of the arm 13b and in the lower face 13a of the support 13, near the central part thereof. That part of the flexible member 22 which hangs freely near the central part of the support 13 terminates in a stop member 9, whilst the other part which hangs from the end of the inclined arm 13b terminates in a ring 11 which is sufficiently small to be able to pass through hole 23.

As is more clearly seen in FIG. 7, the jacket and the trousers of a suit hung on the hanger 13 suspended from bar 5, may then be protected from theft by means of the two flexible members 6 and 22 of which rings 11 are connected to each other by means of a padlock 12. The flexible member 6 extends vertically through the trousers 25 suspended from grippers 21, whilst the other flexible member 22 extends through a sleeve of the jacket 24. The lengths of the two flexible members 6 and 22 are sufficient for the rings 11 provided at their ends to emerge from the trousers 25 and from the sleeve of jacket 24 and to be connected to each other by padlock 12.

Figure 8:
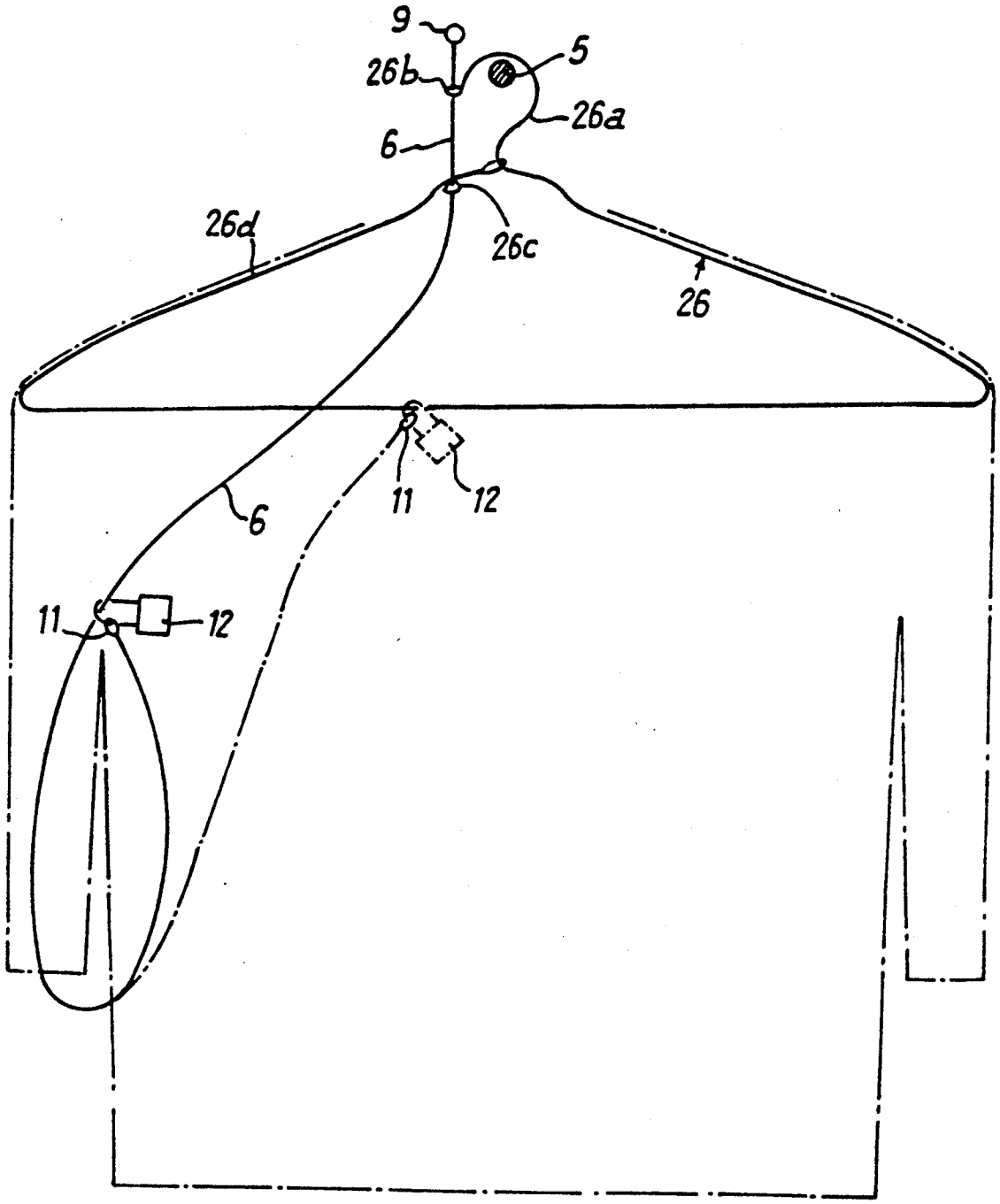
FIG. 8 is a schematic view in elevation of another variant of a hanger.

In the variant embodiment of the invention shown in FIG. 8, the anti-theft hanger is constituted by a curved wire 26 of conventional shape, of which the upper hook 26a terminates in a ring 26b traversed by the flexible member 6 and serving as stop for the stop member 9 fixed to the end of the flexible member 6 when the latter is pulled downwardly. This flexible member 6 also extends through a second ring 26c formed in the upper part of the left-hand inclined wire arm 26d of the hanger 26 substantially in vertical alignment beneath ring 26b. The hanger 26 makes it possible to lock the garment in two different manners, as shown in FIG. 8. In fact, the flexible member may be hooked to itself inside a jacket, forming a loop passing through the sleeve and the interior of the jacket, the padlock 12 in that case being hooked inside the jacket, at the top of the sleeve, passing through the end ring 11 and around the flexible member. Another manner of locking consists in hooking the end ring 11, by means of padlock 12, to the horizontal wire bar of the hanger 26.

What is claimed is:

1. An anti-theft hanger for garments, for use in stores or cloakrooms, comprising:

a support means shaped for hanging garments, said support means having a central part provided with a lower hole;

a suspension hook located in the central part of said hanger for passing around a suspension bar, said suspension hook having an opening and including a curved part having an upper hole therein;

at least one flexible anti-theft member connected to said support means adapted to pass through a tubular part of the garment, and having at least one end fixed to a ring;

a first of said anti-theft flexible members having a free lower end provided with a first ring having provision for passage therethrough of padlock means and said first anti-theft flexible member extending across said hook opening by passing through said upper hole in said curved part; and stop member means fixed to another end of said first flexible anti-theft member;

said first anti-theft flexible member also passing through said lower hole formed in said central part of said support means and said stop member means opposing passage through said upper hole when said first flexible member is pulled downwardly.

2. The anti-theft hanger of claim 1, wherein said lower hole is aligned vertically with said upper hole.

3. An anti-theft hanger as claimed in claim 2, wherein said anti-theft member is a chain.

4. The anti-theft hanger of claim 1, wherein said upper hole extends vertically and opens out at a spot on said curved part into an outer edge of said curved part of said hook, and said curved part having a notch in the outer edge thereof at said spot where said upper hole opens out for receiving said stop member when said first anti-theft flexible member is pulled downwardly.

5. The anti-theft hanger of claim 4, wherein said lower hole and said upper hole are vertically aligned.

6. An anti-theft hanger as claimed in claim 7, wherein said anti-theft member is a chain.

7. An anti-theft hanger as claimed in claim 1, wherein said anti-theft member is a cable.

8. The anti-theft hanger of claim 1, wherein:

said support means is made of a rigid solid material;

said hook being formed from an upper central part;

part of said support means being pierced in an upper part thereof with a curved hole opening outwardly in a lower end face of said curved upper part of said suspension hook and in a lower face of said support means such that said first anti-theft flexible member follows a path in the form of an upturned U through said upper central part of said hanger; and said curved hole having a straight portion forming a vertical hole passing through said support means and said first anti-theft flexible member with its part terminating in said ring passing through said vertical hole through said curved hole outwardly from said upper hole and passing through said support means and said lower hole and opening through a lower face of said support means.

9. The anti-theft hanger of claim 8, wherein said stop member means includes a second ring cooperating with said first ring and said padlock means for locking the ends of said first anti-theft flexible member together.

10. The anti-theft hanger of claim 8, wherein said support means includes two inclined arms; and a horizontal bar extending between a lower end of each of said inclined arms.

11. The anti-theft hanger of claim 10, including another flexible anti-theft member associated with one of said inclined arms having one end fixed to a second ring, and wherein said first and second rings are substantially aligned vertically and each said ring is traversed by said padlock means.

12. In the anti-theft device as claimed in claim 1, including:

arm means extending on either side of said hook;

a horizontal bar extending between said arm means and supported thereby; and grippers on said horizontal bar for gripping articles of clothing.

13. An anti-theft device of claim 12, including:

another flexible anti-theft member extending vertically in the form of an upturned U, said other flexible anti-theft member extending through an arm means hole in one of said bars of said hanger, said arm means hole opening out into a lower face of said bar near a central part thereof, a part of said other anti-theft flexible member which hangs freely near said central part terminating in a stop member, and another part of said other anti-theft flexible member hanging from an end of said arm means terminates in a ring.

14. An anti-theft hanger of claim 1, including another anti-theft hanger having another suspension hook and another flexible anti-theft member therefor, wherein said other anti-theft member includes at an outer end thereof a second ring similar to said first ring, one of said first rings having means to receive said other anti-theft flexible member for locking said rings together.

15. The anti-theft hanger of claim 1, wherein:

said support means has an upper central part forming said suspension hook, said support means being pierced in an upper part thereof with a curved hole opening outwardly in a lower end face of said curved part and in said lower face of said support means, such that said first flexible member follows a path in the form of an upturned U through an upper central part of said hanger;

said curved hole having a medial line, and said first anti-theft flexible member with its part terminating in said ring passes through a vertical hole of said medial line of said curved hole;

said support means including an inclined arm provided with another hole opening out in a lower face of said support means and in a lower face of the end of said arm; and another anti-theft flexible member passing through said support means and in the other hole in said inclined arm and extending through the lower face of said support means and through the lower face of the end of said arm.

16. The anti-theft hanger of claim 1, including:

a horizontal bar extending between lower ends of two inclined arms of said support means;

grippers on said horizontal bar for suspending articles of clothing;

said opening in said suspension hook extending through said curved part in the form of an upturned U, said flexible member extending vertically in the form of an upturned U, through said opening in said suspension hook; and another flexible member extending through another hole in one of said inclined arms of said hanger, said other hole opening out into a lower face of one of said ends of said inclined arm and in the lower face of said support, near a central part of said suspension hook, a part of said other flexible member which hangs freely near said central part of the suspension hook terminating in another stop member, and another part of said other flexible member terminates in another ring.

17. The anti-theft hanger of claim 16, wherein said two rings are substantially aligned vertically and said two rings are traversed by said padlock means.

18. An anti-theft hanger for garments, comprising:

a curved wire forming an upper hook and a pair of arms extending therefrom;

a first ring formed at an end of said upper hook;

a second ring formed on one of said arms and located centrally near said upper hook; and anti-theft flexible locking means including a flexible member extending through said first and said second rings and means for locking said first and said second rings together after passing said flexible member through a tubular part of the garment;

a stop member coupled with one end of said flexible member and a third ring coupled with another end of said flexible member; and padlock means cooperating with said third ring for locking said rings relative to each other.

19. The anti-theft hanger as claimed in claim 18, including:

a transverse wire connected between said pair of arms;

a third ring coupled with said flexible member; and padlock means for locking said third ring with said transverse wire.

* * * * *